US007165991B2

(12) United States Patent
Sato et al.

(10) Patent No.: US 7,165,991 B2
(45) Date of Patent: Jan. 23, 2007

(54) CONNECTOR

(75) Inventors: Koki Sato, Shinagawa (JP); Atsushi Sakurai, Shinagawa (JP); Manabu Shimizu, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/184,867

(22) Filed: Jul. 20, 2005

(65) Prior Publication Data

US 2006/0141852 A1 Jun. 29, 2006

(30) Foreign Application Priority Data

Dec. 28, 2004 (JP) ..... 2004-380580

(51) Int. Cl.
*H01R 12/24* (2006.01)

(52) U.S. Cl. ..... 439/492; 439/422; 439/521; 439/329

(58) Field of Classification Search ..... 439/492, 439/521, 329, 422
See application file for complete search history.

(56) References Cited

U.S. PATENT DOCUMENTS 5,738,545 A * 4/1998 Igarashi et al. ..... 439/607
5,980,273 A * 11/1999 Yong et al. ..... 439/79
6,305,971 B1 * 10/2001 Yu-Feng ..... 439/493

FOREIGN PATENT DOCUMENTS

JP 2004-528692 9/2004
WO 02/089261 11/2002

* cited by examiner

*Primary Examiner*—Truc Nguyen
(74) *Attorney, Agent, or Firm*—Staas & Halsey LLP

(57) ABSTRACT

A connector is disclosed. A plate contact member is fixed to a housing of the connector. The contact member includes an FFC connection contact section. The FFC connection contact section is formed in a U-shape, and includes a base section on which a triangular projection is formed. An FFC is held between the base section and a slider fitted in the housing. The projection pierces a covering of the FFC to come into contact with a wire of the FFC. Thus, the FFC is electrically and mechanically connected to the connector.

6 Claims, 16 Drawing Sheets

CONNECTOR

BACKGROUND OF THE INVENTION

1. Field of the Invention

The present invention relates to a connector, and particularly relates to a connector for a flat ribbon cable connection to which an unterminated end of a flat ribbon cable, such as a flat flexible cable and a printed-wiring cable, having a conductive line covered with a covering is connected.

2. Description of the Related Art

Referring to FIG. 1, a flat flexible cable (FFC) 10 includes multiple copper wires 11, each serving as a conductive line and having a rectangular cross-sectional shape, arranged at predetermined intervals P. The FFC 10 is entirely laminated and covered with a polyester sheet, and is formed into a flat ribbon shape. A lamination polyester covering is denoted by the reference number 12. Both faces 13 and 14 are flat. A thickness of the polyester covering 12 is t.

This type of FFC 10 has become widely used in recent years because of the intervals p, which can be made as narrow as, for example, 0.5 mm, and low costs.

In an example of a connector with such an FFC connected thereto known in the art, a covering on one side of an end of an FFC is removed to expose wires therein, and the exposed wires are put into contact with contact members of the connector.

International Application No. PCT/US02/11143 (Published Japanese translation No. 2004-528692) discloses another example of a connector with such an FFC connected thereto. In this example, an unterminated FFC is placed on the upper side of U-shaped contact members. Then, the FFC is pushed into the contact members by an actuator so that the FFC forms a U-shape along the inner surface of the contact members. While the FFC is pushed into the contact members, a covering is cut to partially expose wires. Thus, a part of each of the contact members comes into contact with the corresponding exposed wire to establish an electrical connection.

Unfortunately, the first example is not cost-effective because it requires cable termination.

On the other hand, the second example does not have such a cost disadvantage because it requires neither cable termination nor soldering. However, in the process of connecting the contact members to the wires, the covering is tore, and the thus exposed wires are dragged on the contact members. This may damage the wires, resulting in lowering of reliability of the electrical connection between the contact members and the wires.

In the case of printed wiring cables, it is troublesome to solder contact members to terminal sections arranged at an end of a cable. If lead-free tin solder is used, short circuits might develop due to occurrence of whiskers.

SUMMARY OF THE INVENTION

A general object of the present invention is to provide a connector device for flat ribbon cable connection to solve at least one problem described above.

According to an aspect of the present invention, there is provided a connector to which an end of a flat ribbon cable including a conductive line covered with a covering is to be connected, comprising: a housing; a contact member secured to the housing, including a flat flexible cable connection contact section that is formed in a U-shape for receiving the end of the flat flexible cable therein and includes a projection on at least one of opposing inner edges of the U-shaped flat flexible cable connection contact section; and a slider configured to elastically deform the flat ribbon connection contact section; wherein the flat flexible cable connection contact section and the slider are configured such that when the slider is fitted with respect to the flat flexible connection contact section an elastic force is generated in the flat flexible connection contact section, and the slider presses the flat flexible cable against said at least one of the opposing inner edges of the flat flexible connection contact section such that the projection pierces the covering of the flat flexible cable to come into contact with and press the conductive line.

According to the present invention, an end of a flat ribbon cable can be connected without soldering while preventing a wire from being dragged on and damaged by a projection.

DETAILED DESCRIPTION OF THE PREFERRED EMBODIMENT

The following description provides exemplary embodiments of the present invention with reference to the accompanying drawings.

[Fist Embodiment]

Figure 2:
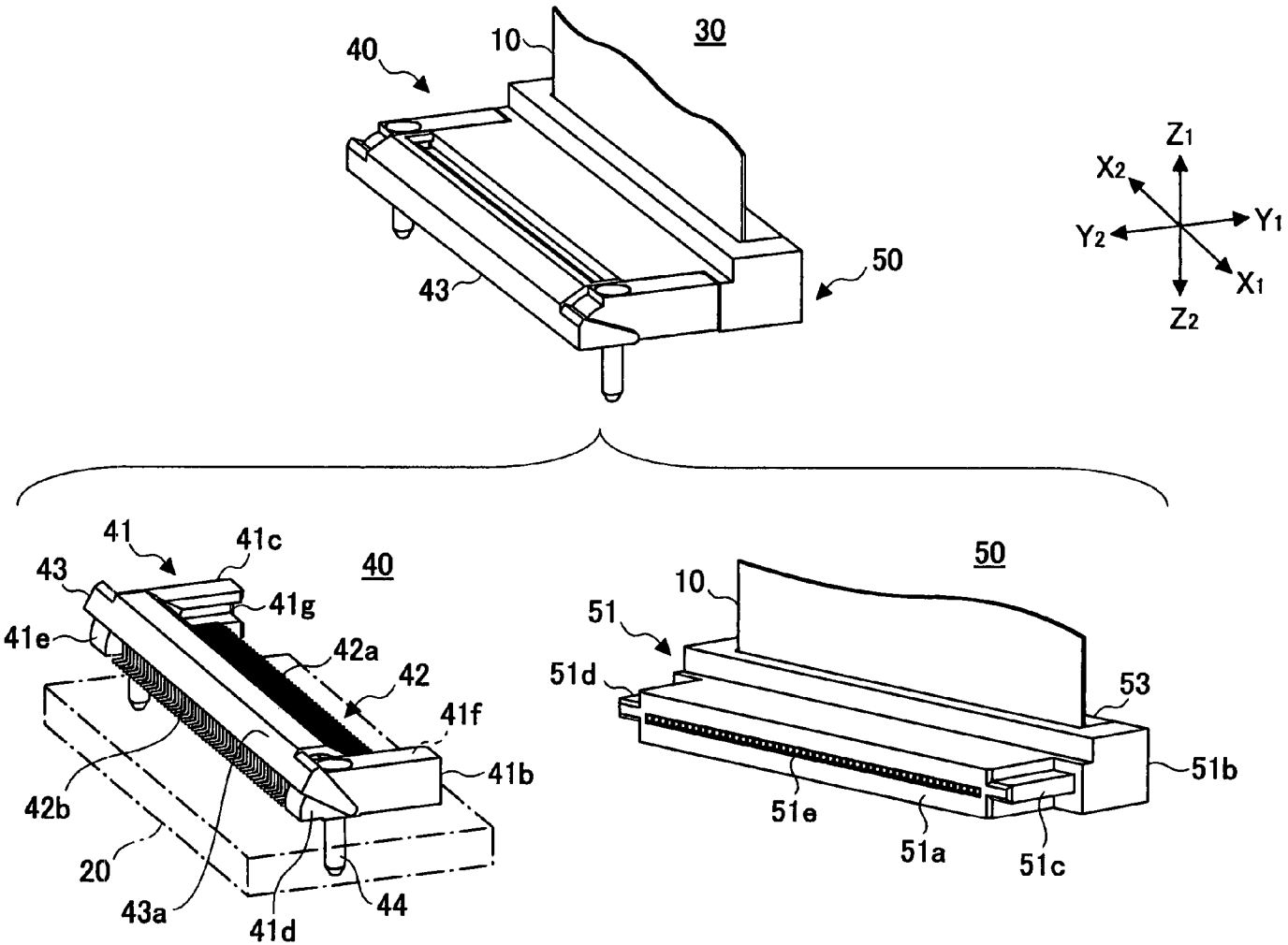
FIG. 2 is a perspective view illustrating a connector device according to a first embodiment of the present invention.
Figure 3:
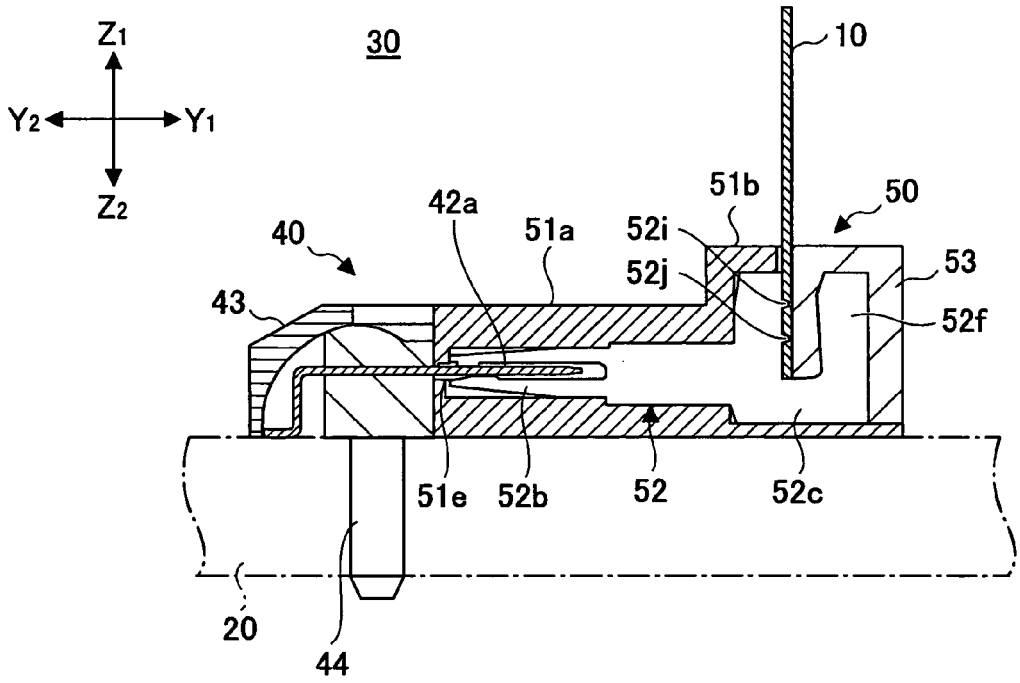
FIG. 3 is a cross-sectional view illustrating the connector device of FIG. 2.

Referring to FIGS. 2 and 3, a connector device 30 according to a first embodiment of the present invention includes a right-angle plug connector 40 mounted on a printed board 20, and a jack connector 50 to which an unterminated end of a flat flexible cable (FFC) 10 is electrically and mechanically connected. The jack connector 50 is configured to be connected to the plug connector 40. When the jack connector 50 is connected to the plug connector 40, wires 11 at an end of the FFC 10 are electrically connected to the printed board 20 through the connector device 30. The FFC 10 is perpendicular to a direction in which the jack connector 50 fits into the plug connector 40. Throughout the drawings, X1–X2 indicates a width direction of the connector device 30; Y1–Y2 indicates a connection direction thereof; and Z1–Z2 indicates a height direction thereof.

[Plug Connector 40]

The following describes the plug connector 40 serving as a board-side connector. Referring to FIGS. 4–6B, the plug connector 40 includes an angular C-shaped insulating housing 41, multiple pin type contact members 42 arranged in the X direction in the housing 41, a dust-proof cover 43 attached to the Y2 side of the housing 41, and a pair of positioning pins 44 threaded through the housing 41 in the Z direction and fixed thereto for mounting the plug connector 40 on the printed board 20.

The housing 41 includes a main section 41*a* elongated in the X direction, arms 41*b* and 41*c* extending in the Y1 direction from opposing ends of the main section 41*a*, respectively, and rear arms 41*d* and 41*e* extending in the Y2 direction. Guide grooves 41*f* and 41*g* are formed on opposing inner faces of the arms 41*b* and 41*c*, respectively.

Each of the contact members 42 includes a pin contact section 42*a* and a Y2-side crank-shaped terminal section 42*b* to be soldered. The contact members 42 are inserted through holes of the main section 41*a* from the Y2 side such that the pin contact sections 42*a* are arranged between the arms 41*b* and 41*c* at intervals p, and that the crank-shaped terminal sections 42*b* are arranged at the intervals p between the rear arms 41*d* and 41*e*.

The dust-proof cover 43 includes a cover main section 43*a*, arms 43*b* and 43*c* extending in the Y1-direction from the Y1 direction from opposing ends of the cover main section 43*a*, respectively, and projecting pieces 43*d* and 43*e* extending in the Y1 direction from vicinities of opposing ends of the cover main section 43*a*, respectively. The cover main section 43*a* is configured to cover an area between the rear arms 41*d* and 41*e*. The arms 43*b* and 43*c* are configured to fit the outer sides of the arms 41*b* and 41*c* while shafts (not shown) provided at the front sides of the arms 43*b* and 43*c* are fitted in a bearing recess 41*h* and a bearing recess 41*i* (not shown) formed in outer faces of the arms 41*b* and 41*c*, respectively. Thus, the dust-proof cover 43 is attached to the housing 41 at the Y2 side thereof to be rotatable about the bearing recesses 41*h* and 41*i*.

Figure 4:
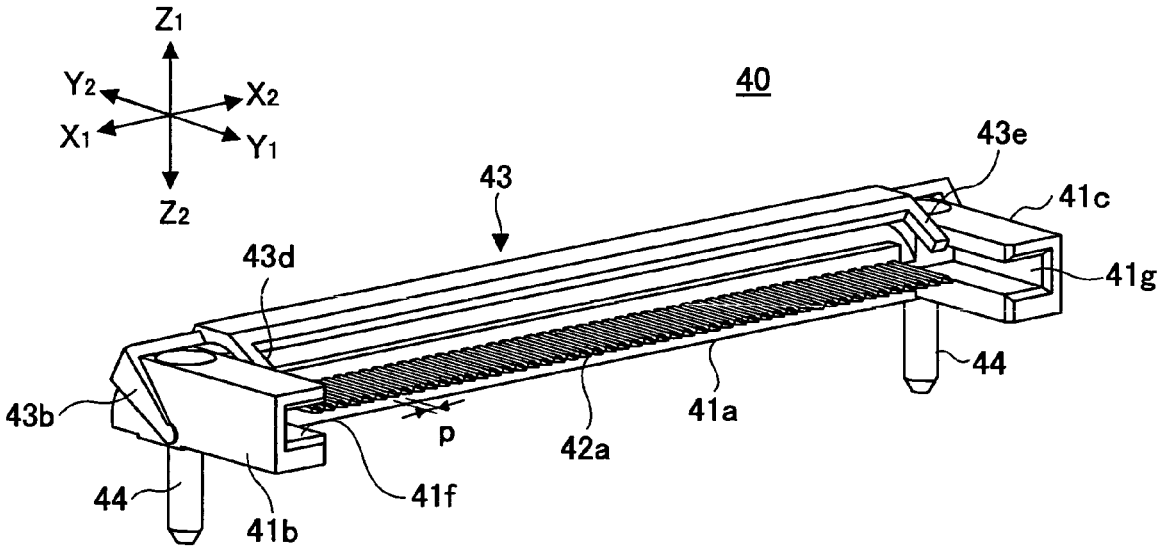
FIG. 4 is a perspective view illustrating a plug connector.
Figure 5:
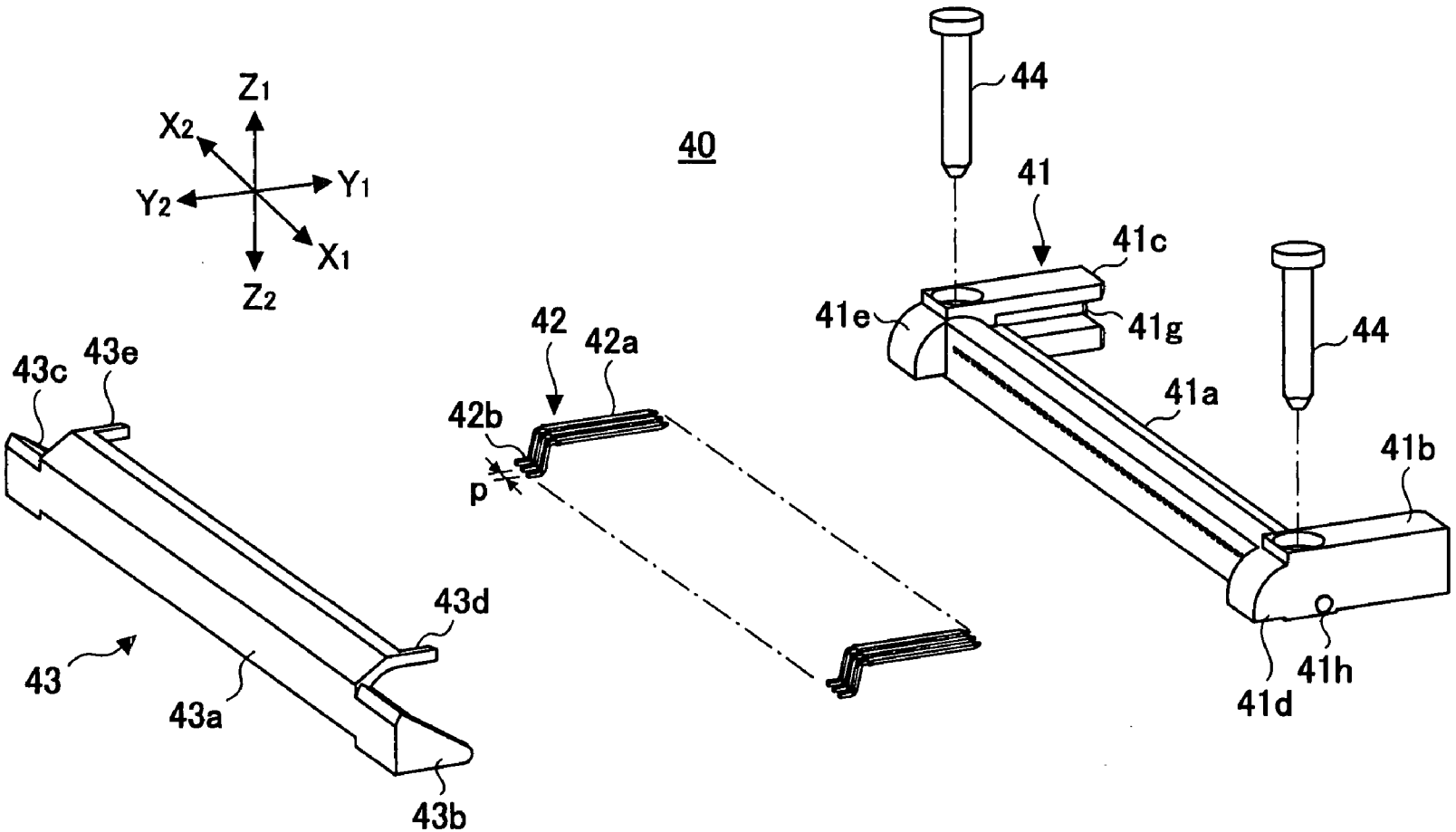
FIG. 5 is an exploded perspective view illustrating the plug connector.
Figure 6A:
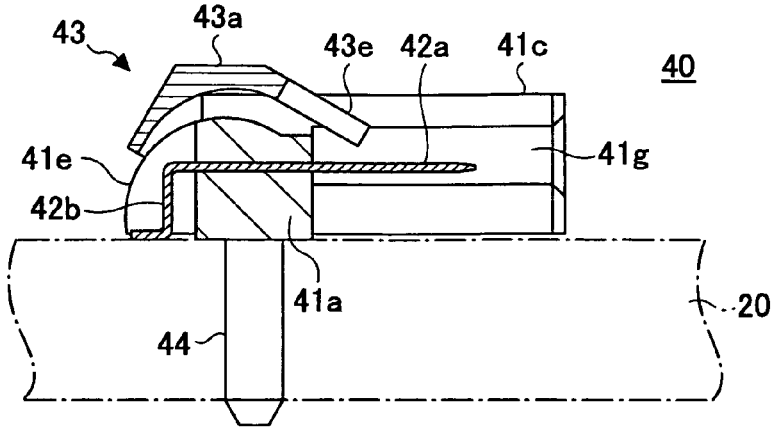
FIGS. 6A and 6B are cross-sectional views each illustrating the plug connector.

During assembly and shipment of the plug connector 40, the dust-proof cover 43 is rotated in the clockwise direction viewed from the X1 side and locked in the position shown in FIGS. 4 and 6A by an engagement of a recess and a projection (both not shown). In this state, an area where the terminal sections 42*b* are arranged is not covered, and front ends of the projecting pieces 43*d* and 43*e* are located at positions opposing the guide grooves 41*f* and 41*g*, respectively. The reason that the area where the terminal sections 42*b* are arranged is not covered is because to surely heat the terminal sections 42*b* in a reflow process. The reason that the front ends of the projecting pieces 43*d* and 43*e* are located at the positions opposing the guide grooves 41*f* and 41*g* is to cause front ends of the projecting pieces 43*d* and 43*e* to be pushed by a front end of the jack connector 50 upon connecting the jack connector 50 to the plug connector 40.

Figure 6B:
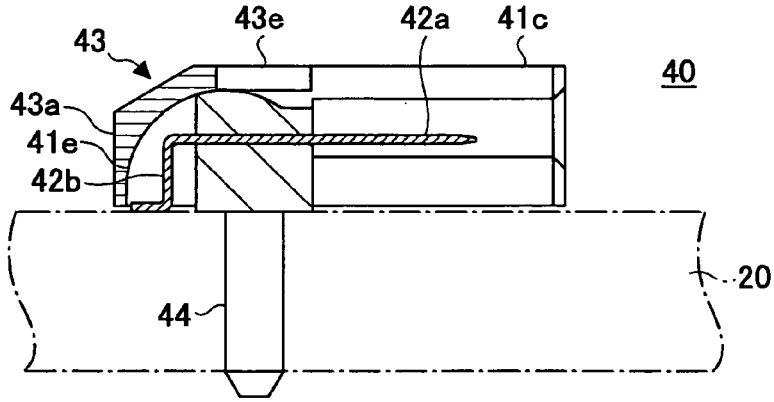

When the dust-proof cover 43 is rotated in the counter-clockwise direction viewed from the X1 side until it is locked in the position shown in FIGS. 3 and 6B with a clicking sound by an engagement of a recess and a projection (both not shown), the cover main section 43*a* covers the area where the terminal sections 42*b* are arranged.

The plug connector 40 is mounted on the printed board 20 by reflow soldering the terminal sections 42*b* to a pad formed on the printed board 20, while keeping the dust-proof cover 43 opened as shown in FIGS. 4 and 6A. Because the dust-proof cover 43 is opened during the reflow soldering, the terminal sections 42*b* are effectively heated and therefore the reflow soldering can be efficiently performed.

Upon connecting the jack connector 50 to the plug connector 40, the front end of the jack connector 50 pushes the front ends of the projection pieces 43*d* and 43*e*, so that the dust-proof cover 43 is rotated to the position shown in FIGS. 3 and 6B. Thus, the Z1 side and the Y2 side of the terminal sections 42*b* soldered on the printed board 20 are covered with the dust-proof cover 43. The X1 and X2 sides of a space in the inner side of the dust-proof cover 43 are shut by the rear arms 41*d* and 41*e*, respectively. If the terminal sections 42*b* are exposed during use of an apparatus in which the plug connector 40 is attached, dust floating inside the apparatus is adhered to the terminal sections 42*b* in some years due to static electricity. The adhered dust may cause troubles such as short circuits between the terminal sections 42*b*. Covering the terminal sections 42*b* with the dust-proof cover 43 as described above prevents dust adhesion to the terminal sections 42*b*, thereby minimizing occurrence of short circuits between the terminal sections 42*b*. The dust-proof cover 43 is kept closed even after the jack connector 50 is disconnected.

[Configuration of Jack Connector 50]

The following describes the jack connector 50 with reference to FIGS. 2–3 and 7–11

Figure 7:
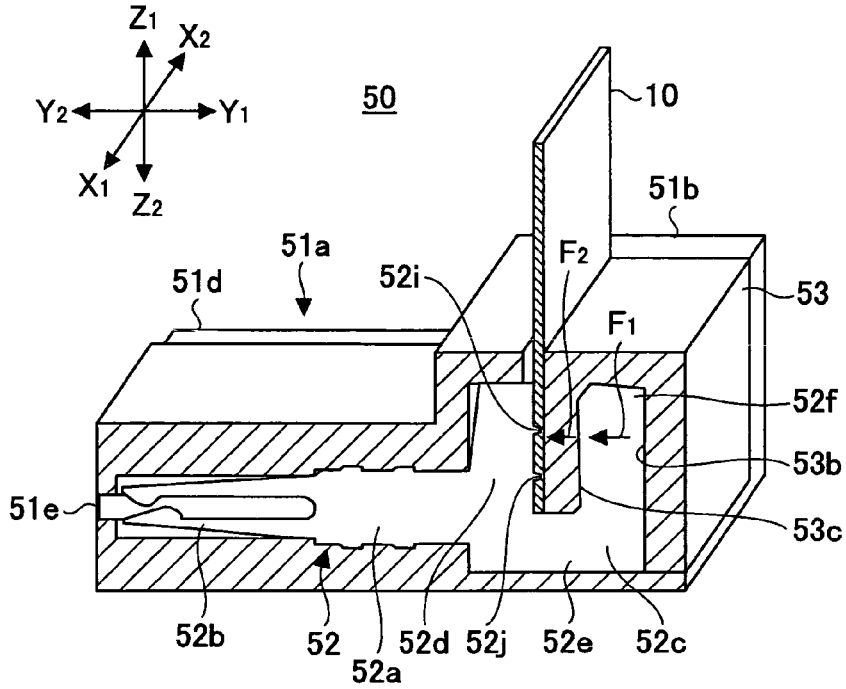
FIG. 7 is a cross-sectional view of a jack connector.
Figure 8:
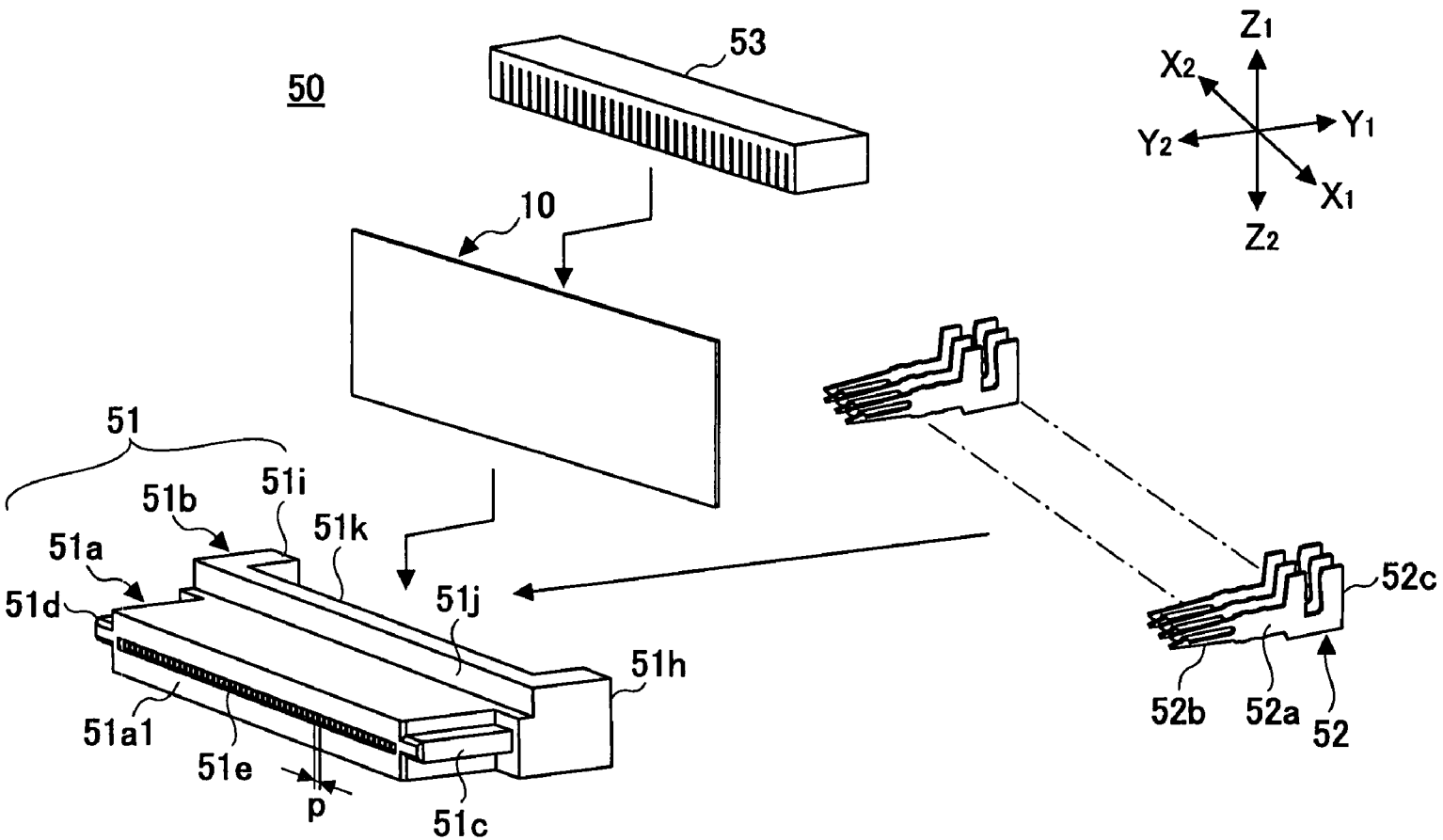
FIG. 8 is an exploded perspective view illustrating the jack connector.
Figure 9:
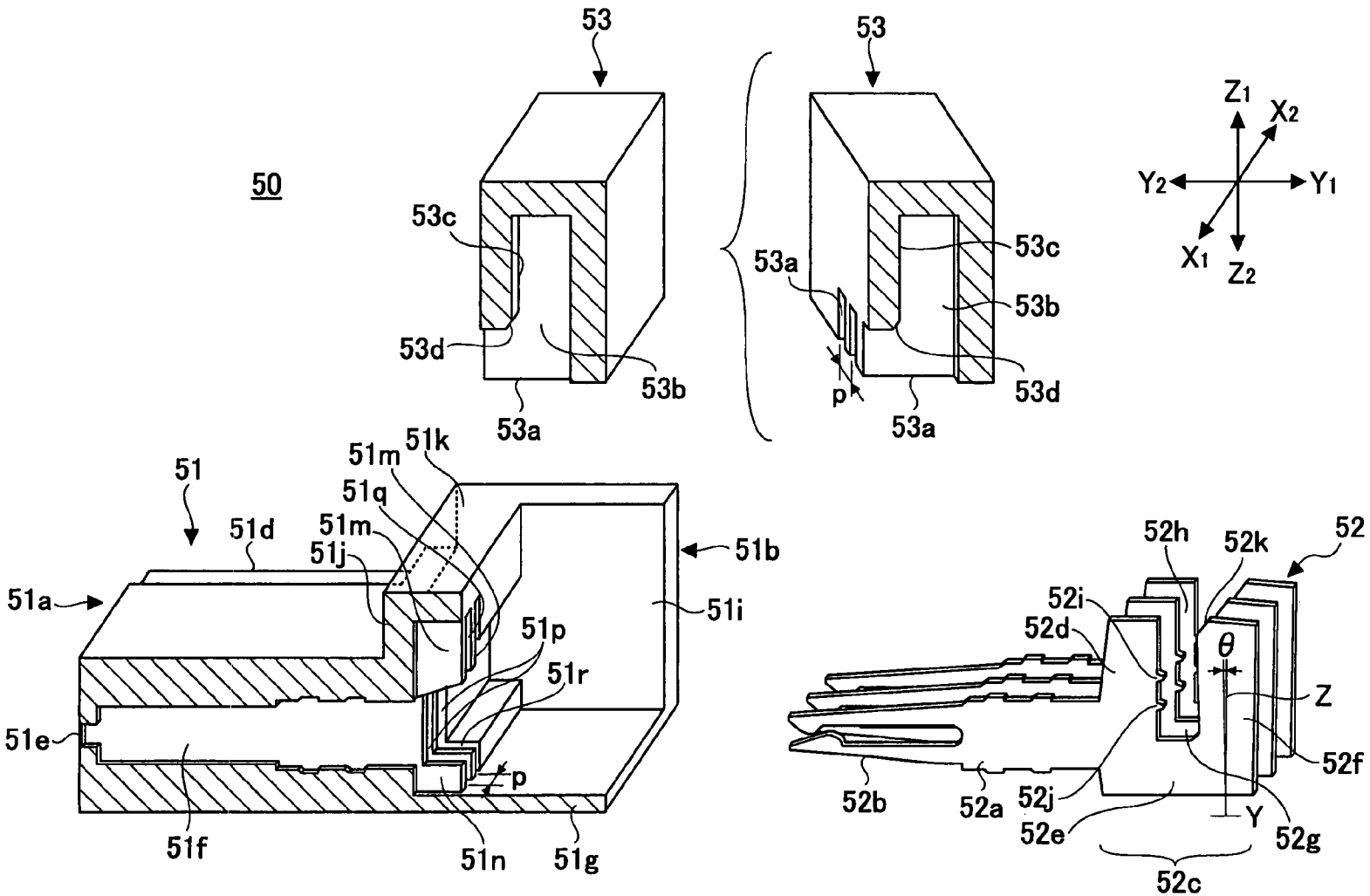
FIG. 9 is an exploded perspective cross-sectional view of the jack connector.
Figure 10:
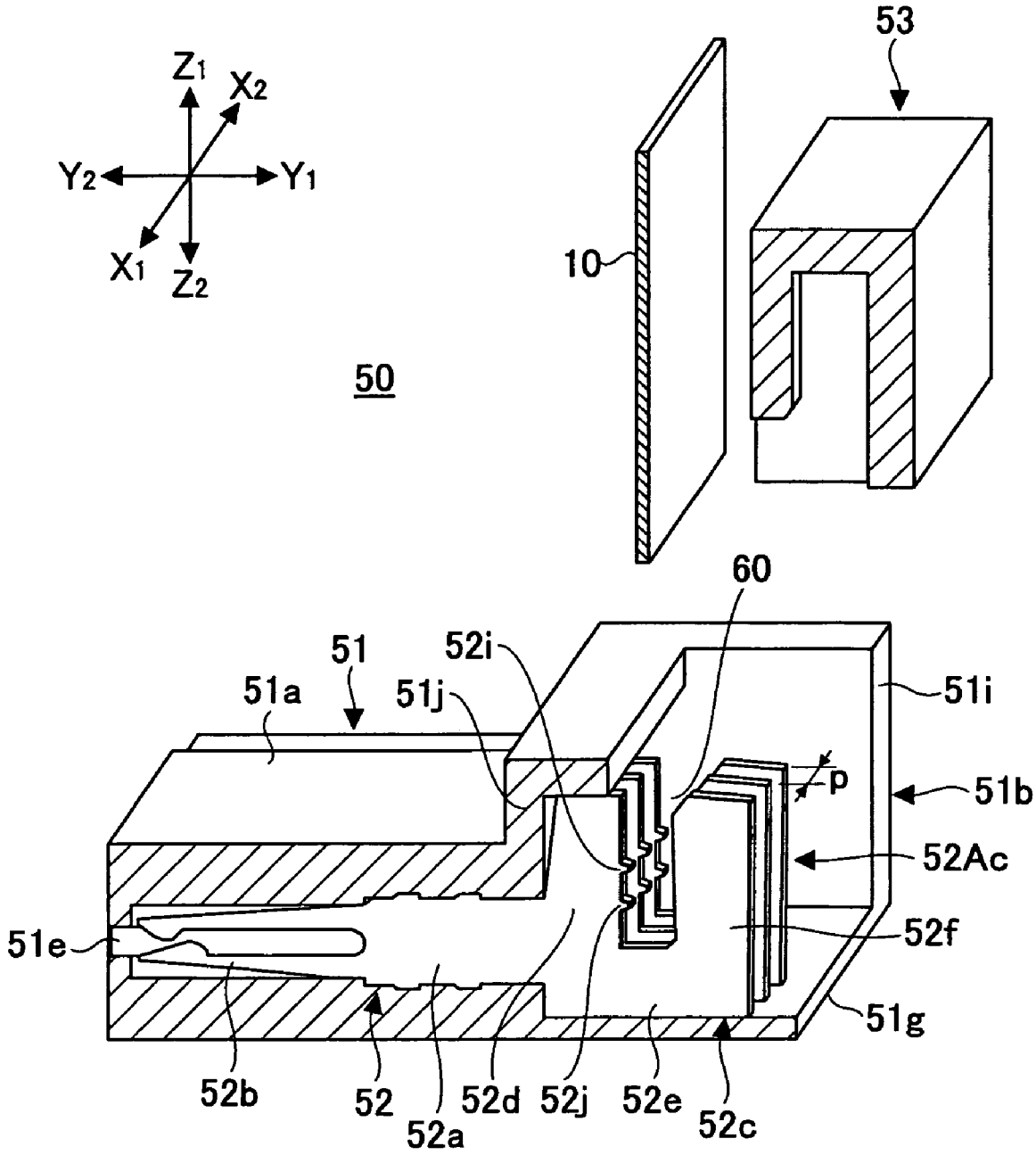
FIG. 10 is an exploded perspective cross-sectional view of the jack connector with contact members mounted therein.
Figure 11A:
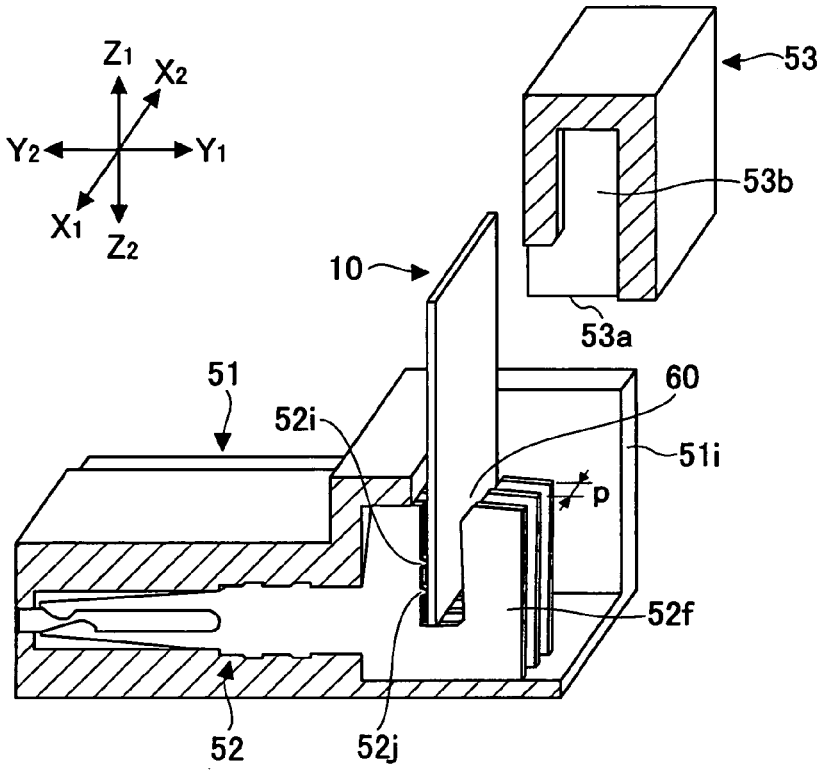
FIGS. 11A and 11B are diagrams illustrating operations for connecting the FFC to the jack connector.
Figure 11B:
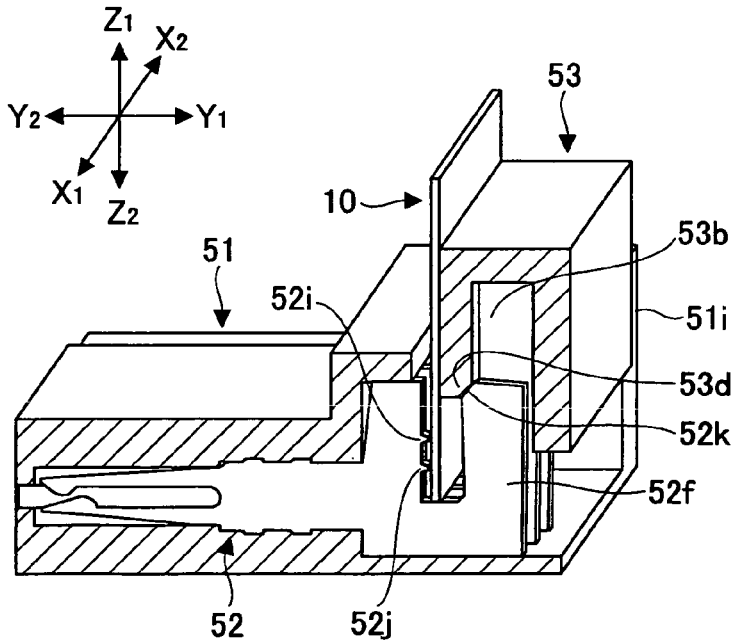

FIG. 7 is a cross-sectional view illustrating the jack connector 50. FIG. 8 shows an exploded view of the jack connector 50 with the FFC 10. FIG. 9 is an exploded cross-sectional view illustrating the jack connector 50. FIG. 10 is an exploded view illustrating the jack connector 50 with contact members 52 mounted therein. FIGS. 11A and 11B are diagrams illustrating operations for connecting the FFC 10 to the jack connector 50.

Referring mainly to FIG. 10, the jack connector 50 includes an insulating housing 51, multiple plate contact members 52 arranged in the X direction and fixed to the housing 51, and a slider 53 configured to fit the housing 51. An unterminated end of the flat flexible cable (FFC) 10 is connected to the jack connector 50 without soldering.

Referring to FIGS. 8 and 9, the housing 51 includes a Y2-side housing section 51*a* at the Y2 side, and a Y1-side housing section 51*b* at the Y1 side.

The Y2-side housing section 51*a*, which is a section fitted into the plug connector 40, includes guide rails 51*c* and 51*d* one on each end in the X direction, and multiple openings 51*e* arranged at the intervals p in the X direction in a front end face 51*a*1. As shown in FIG. 9, slits 51*f* communicating with the corresponding openings 51*e* are arranged in the X direction at the intervals p in the Y2-housing section 51*a*. The slits 51*f* are elongated in the Y direction and configured to fit pinch contact sections 52*b* and center sections 52*a* of the corresponding contact members. 52.

The Y1-side housing section 51*b* has a box shape, which is elongated in the X direction and configured to fit FFC connection contact sections 52*c* of the contact members 52 and the slider 53, with the Z1 and Y1 sides thereof opened, and includes a bottom plate 51*g* at the Z2 side, end face plates 51*h* and 51*i* opposing each other in the X direction, a side plate 51*j* at the Y2 side, a top plate 51*k* continuous to the side plate 51*j*, and partition ribs 51*m* and 51*n*. Slit ports 51*p* corresponding to Y1-side ends of the slits 51*f* are formed in the side plate 51*j*. The partition ribs 51*m* extending across the side plate 51*j* and the top plate 51*k*, and the partition ribs 51*n* extending across the side plate 51*j* and the bottom plate 51*g* are formed between adjacent slit ports 51*p*. Slits 51*q* are formed between adjacent partition ribs 51*m*, while slits 51*r* are formed between adjacent partition ribs 51*n*.

As best shown in FIG. 9, each of the plate contact members 52 includes the center section 52*a* having a bulging portion, the pinch contact section 52*b* at the Y2 side, and the FFC connection contact section 52*c* at the Y1 side. The FFC connection contact section 52*c* has a U-shape, and includes a base section 52*d* continuous to the center section 52*a* and elongated in the Z direction, a bottom arm section 52*e* extending in the Y1 direction from a Z2-side portion of the base section 52*d*, and a vertical arm section 52*f* extending in the Z1 direction from a Y1-side end of the bottom arm section 52*e*. A clearance 52*g* is surrounded by the base section 52*d*, the bottom arm section 52*e*, and the vertical arm section 52*f*. The Z1 side of the clearance 52*g* is an opening 52*h*. The base section 52*d* and the vertical arm section 52*f* are configured to oppose each other. The base section 52*d* serves as a first arm, while the vertical arm section 52*f* serves as a second arm. Triangular projections 52*i* and 52*j* projecting in the Y1 direction are formed on an edge of the base section 52*d* at the clearance 52*g* side. The projections 52*i* and 52*j* are configured to pierce the polyester covering 12 to come into contact with the wire 11 of the FFC 10 shown in FIG. 1. An inclined face 52*k* for facilitating insertion of the slider 53 is formed at the Y2 side of a Z1-side end of the vertical arm section 52*f*. The vertical arm section 52*f* is inclined toward the Y2 side at a small angle θ with respect to a Z-axis. The vertical arm section 52*f* has a width that enables a slight elastic deformation thereof such that an upper end thereof may be moved in the Y1 direction.

Referring to FIG. 10, each of the contact members 52, with the pinch contact section 52*b* at the Y2 side, is inserted from the Y1 side of the housing 51 into the slit 51*f* through the slit port 51*p*. When the center section 52*a* is pushed into the slit 51*f* until the base section 52*d* abuts an inner face of the side plate 51*j*, the contact member 52 is fixed. The front end of the pinch contact section 52*b* is arranged to oppose the opening 51*e*. A Z1-side portion of the base section 52*d* of the FFC connection contact section 52*c* is fitted into the slit 51*q*, while a Z2-side portion of the base section 52*d* is fitted into the slit 51*r*. As such, the position of the base section 52*d* is fixed. The bottom arm section 52*e* is supported on the bottom plate 51*g*. The FFC connection contact sections 52*c*, each arranged as described above, are arranged in the X direction at the intervals p. These FFC connection contact sections 52*c* arranged in the X direction are referred to as an FFC connection contact section array 52Ac.

As shown in FIG. 10, the FFC connection contact section array 52Ac is exposed except Y2-side portions of the base sections 52*d*. In the FFC connection contact section array 52Ac, the clearances 52*g* continuously extend in the X direction, forming a groove 60 opened toward the Z1 side and elongated in the X direction. Inner faces of the end face plates 51*h* and 51*i* of the Y1-side housing section 51*b* define ends of the groove 60 and serve to determine the position of the FFC 10 inserted as described below.

The positions of the base sections 52*d* are fixed by the partition ribs 51*m*, 51*n* and the slits 51*q*, 51*r*, so that the base sections 52*d* are accurately arranged at the intervals p. Also, the base sections 52*d* are not able to deform in the X direction.

The slider 53 is a rectangular solid with a size that tightly fits into the Y1-side housing section 51*b*, and includes, as shown in FIG. 9, slit ports 53*a* each extending across a Z2-side face and a Y2-side face, and slits 53*b* extending inwardly from the corresponding slit ports 53*a*. The slit ports 53*a* and the slits 53*b* are arranged at intervals p in the X direction. Each of the slits 53*b* has a shape that fits a part of the bottom arm section 52*e* and the vertical arm section 52*f* of the FFC connection contact section 52. The slider 53 further includes a wall face 53*c* facing the Y2 side of the slit 53*b*, and an inclined face 53*d* formed at a Z2-side end of the wall face 53*c* for facilitating insertion of the slider 53.

[Connecting FFC 10 to Jack Connector 50]

The following describes operations for connecting the FFC 10 to the jack connector 50.

Figure 1:
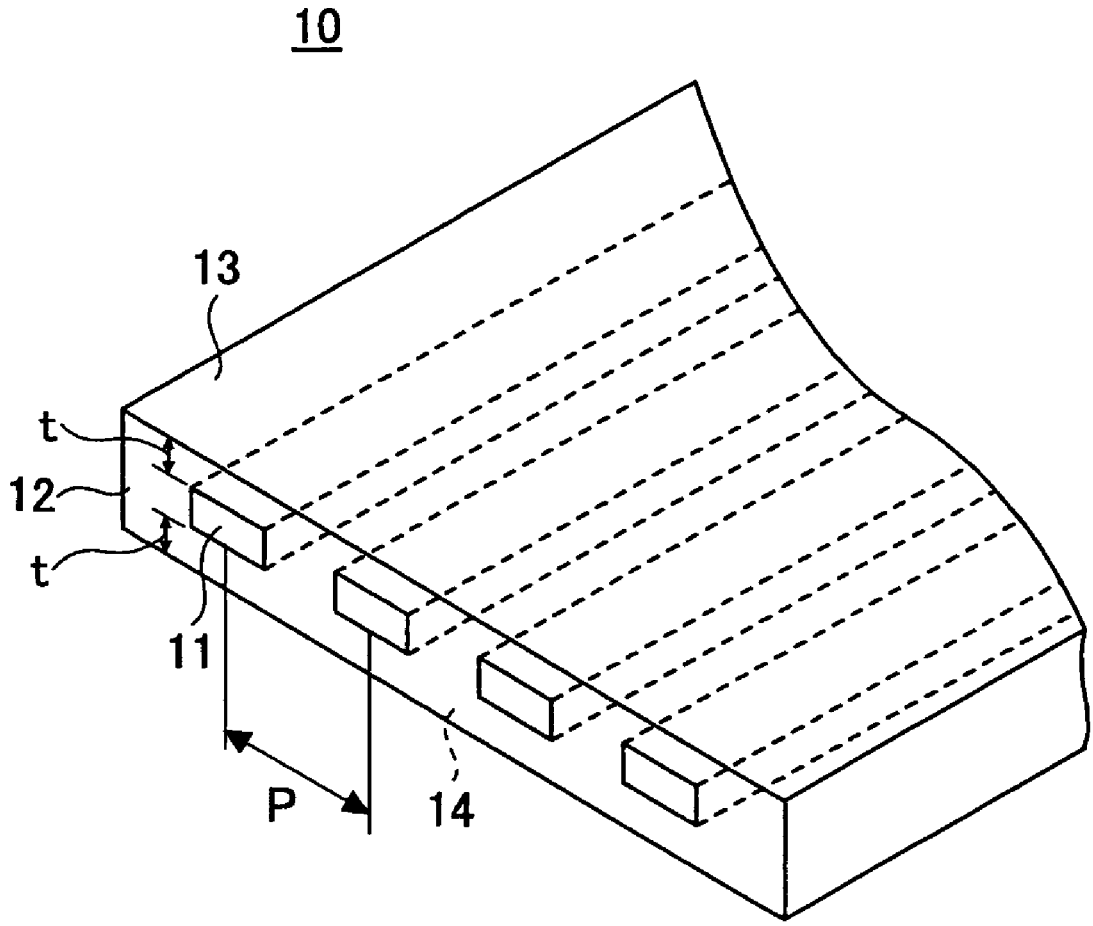
FIG. 1 is a perspective view illustrating a flexible flat cable (FFC)

The FFC 10 has an end which is simply cut, or an unterminated end, as shown in FIG. 1.

Referring to FIG. 11A, the end of the FFC 10 is inserted into the groove 60 until the end abuts the bottom of the groove 60. The FFC 10 is oriented upright with respect to the housing 51, and a further movement of the FFC 10 in the Z2 direction is prevented. The opposing side ends of the FFC 10 in the width direction abut inner faces of the end face plates 51*h* and 51*i*, respectively, and thus the position of the FFC 10 in the X direction is determined. In this state, the wires 11 oppose the corresponding base sections 52*d* of the contact members 52.

Then, the slider 53 is pushed and fitted into the Y1-side housing section 51*b* from the Z1 side.

Figure 12A:
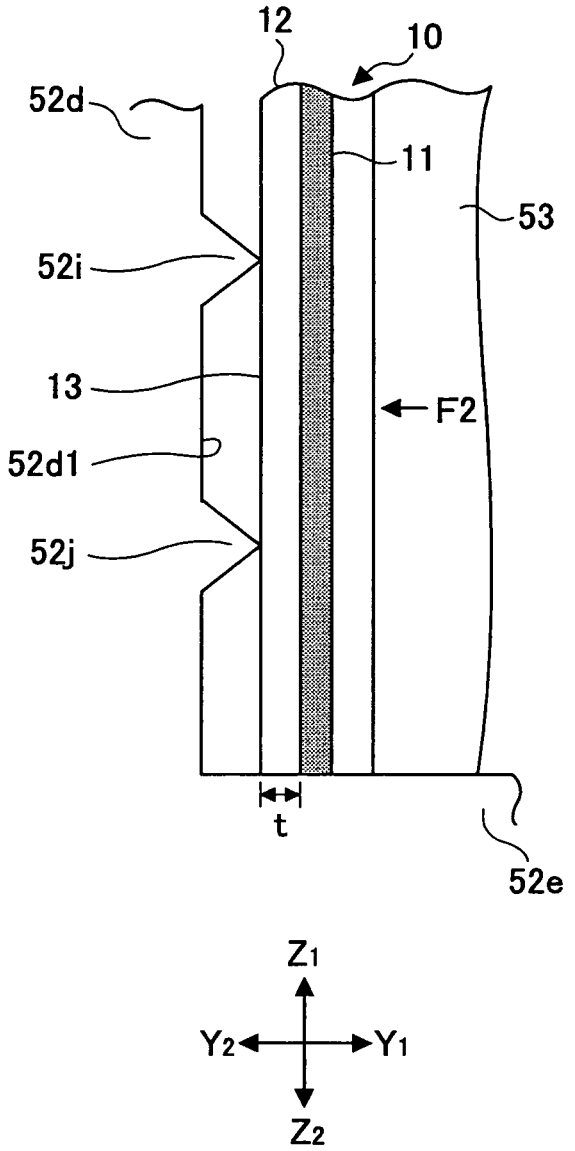
FIGS. 12A and 12B are diagrams illustrating a relationship between projections and the FFC connected to the jack connector in detail.

First, opposing ends of the slider 53 abut the end face plates 51*h* and 51*i*, respectively, and thus the position of the slider 53 in the X direction is determined. Then, the slit ports 53*a* are fitted onto a Z1 end of the vertical arm section 52*f*. Subsequently, with reference to FIG. 11B, the slider 53 is lightly pushed in to move the FFC 10 to the Y2 side in the groove 60. Thus, the inclined face 53*d* comes into contact with the inclined face 52*k* of the vertical arm section 52*f*. Meanwhile, projections 52*i* and 52*j* come into contact with the FFC 10 as shown in FIG. 12A.

When the slider 53 is strongly pushed in, the inclined face 53*d* slides on the inclined face 52*k* to elastically deform the vertical arm section 52*f* in the clockwise direction. The wall face 53*c* holds a Y2-side end face of the vertical arm section 52*f* to keep the vertical arm section 52*f* deformed. The slider 53 is pushed and fitted into a final position shown in FIG. 7 where the slider 53 abuts the bottom plate 51*g*.

While the slider 53 is pushed in, the slider 53 slides on a Y1-side face of the FFC 10 without moving the FFC 10 in the Z2 direction.

Figure 12B:
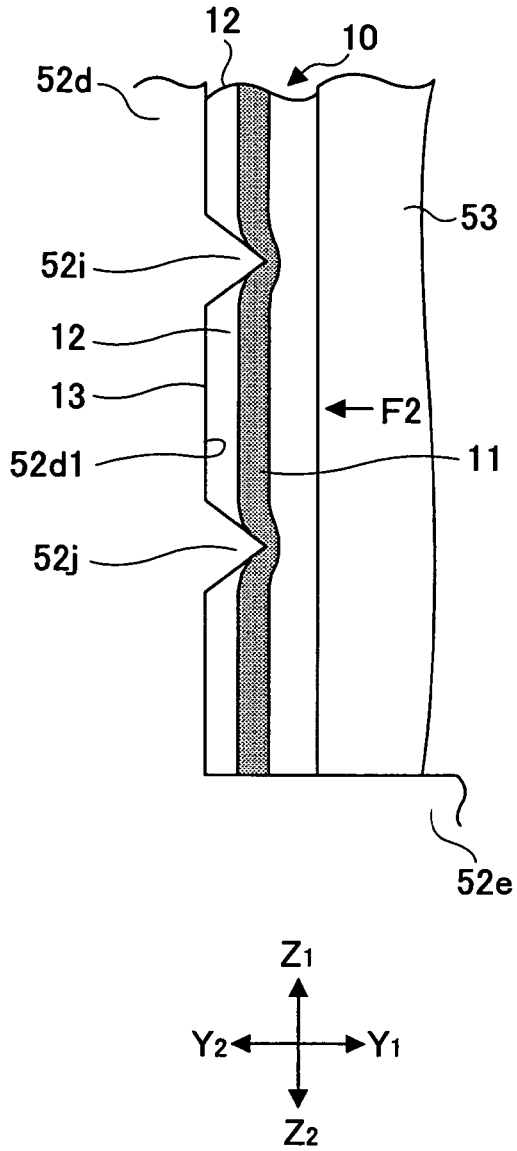

The vertical arm section 52*f* generates an elastic force F1, which is applied to the wall face 53*c*. Accordingly, a force F2 in the Y2 direction is applied to the slider 53. The FFC 10 is strongly pushed against a Y2-side face of the groove 60 by the slider 53, so that the projections 52*i* and 52*j* pierce the polyester covering 12 to come into contact with and press the wire 11 as shown in FIG. 12B. As such, all the wires 11 of the FFC 10 are electrically connected to the corresponding contact members 52 of the jack connector 50.

Because wires 11 are merely pressed against the projections 52*i* and 52*j* without being dragged on the projections 52*i* and 52*j*, the wires 11 are prevented from damage.

The position of the FFC 10 in the X direction is fixed and the positions of the projections 52*i* and 52*j* are determined by the partition ribs 51*m*, 51*n* and the slits 51*q*, 51*r*. Therefore, even when the interval p is as narrow as, for example, 0.5 mm, the projections 52*i* and 52*j* are press-fitted on the approximate center of the corresponding wire 11 to ensure there is an electrical connection.

As the final position of the FFC 10 in the Y direction is where the Y2-side face 13 of the FFC 10 is held on an end face 52*d*1 of the base section 52*d* as shown in FIG. 12B, the wire 11 is prevented from being pressed excessively hard against the projections 52*i* and 52*j* and thus being locally excessively curved and damaged.

The projections 52*i* and 52*j* pierce the polyester covering 12 to partly bite into the wire 11. Accordingly, the FFC 10 is mechanically surely connected to the jack connector 50.

Since the bottom arm section 52*e* is supported on the bottom plate 51*g*, the FFC connection contact section 52*c* is not curved in the Z2 direction even if the slider 53 is strongly pushed in. Therefore, the slider 53 can be smoothly fitted into the Y1-side housing section 51*b*.

When the FFC 10 is connected to the jack connector 50, all the vertical arm sections 52*f* and the bottom arm sections 52*e* are covered by the slider 53, thereby preventing short circuits.

As each of the wires 11 is electrically connected to the corresponding contact member 52 at two points, the reliability of electrical connection is higher compared to a case where the wire 11 is electrically connected at only one point.

The front end of the FFC 10 is stored inside the jack connector 50 without being exposed outside the jack connector 50, thereby preventing short circuits.

A printed wiring cable that has a wiring pattern serving as a conductive line and having a surface coated with polyimide resin may be used in place of the FFC 10, and can be connected to the jack connector 50 in the same manner as described above. In this case, the projections 52*i* and 52*j* pierce the polyimide resin to come into contact with the wiring pattern.

[Connecting Jack Connector 50 to Plug Connector 40]

Referring back to FIGS. 2 and 3, the guide rails 51*c* and 51*d* of the jack connector 50 are guided by the guide grooves 41*f* and 41*g*, and the pin contact sections 42*a* relatively pass through the openings 51*e* to be inserted into the corresponding pinch contact sections 52*b*. In this way, the jack connector 50 is connected to the plug connector 40. As a result, the wires 11 at the end of the FFC 10 are electrically connected to the printed board 20 through the connector device 30. The front ends of the projecting pieces 43*d* and 43*e* are pushed by the front end the jack connector 50, so that the dust-proof cover 43 is rotated in the position shown in FIGS. 3 and 6B to cover the terminal sections 42*b* soldered to the printed board 20.

[Second Embodiment]

Figure 13:
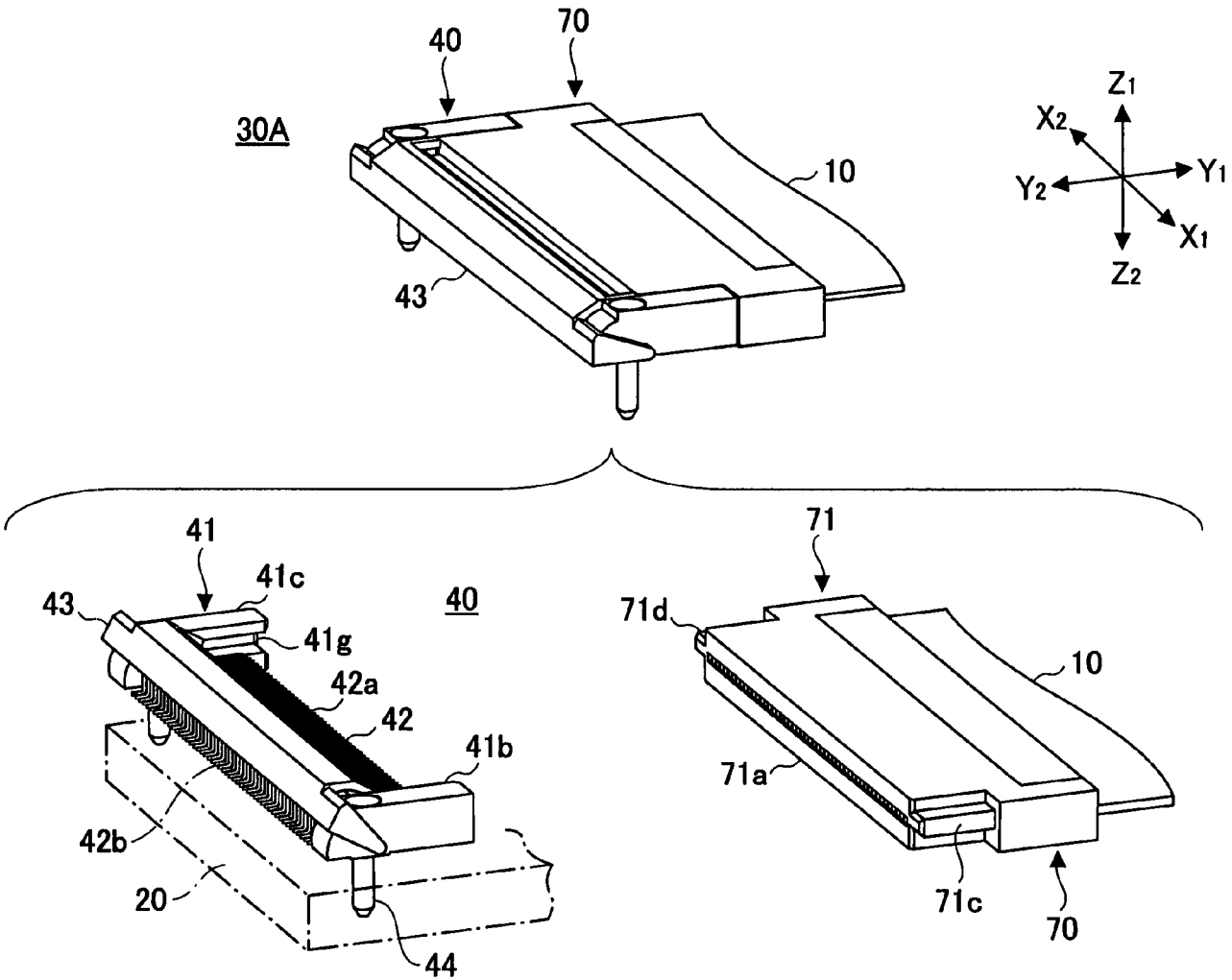
FIG. 13 is a perspective view illustrating a connector device according to a second embodiment of the present invention.

FIG. 13 is a perspective view illustrating a connector device 30A according to a second embodiment of the present invention. The connector device 30A includes a plug connector 40 and a jack connector 70 connected to the plug connector 40. An unterminated end of an FFC 10 is connected to the jack connector 70. Comparing the connector device 30A with the connector device 30 of FIG. 2, the jack connector 70 is different from the jack connector 50 of FIG. 2 in that the orientation of the FFC 10 with respect to the jack connector 70 is the direction in which the jack connector 70 is connected to the plug connector 40.

The following describes the jack connector 70 in detail.

Figure 14:
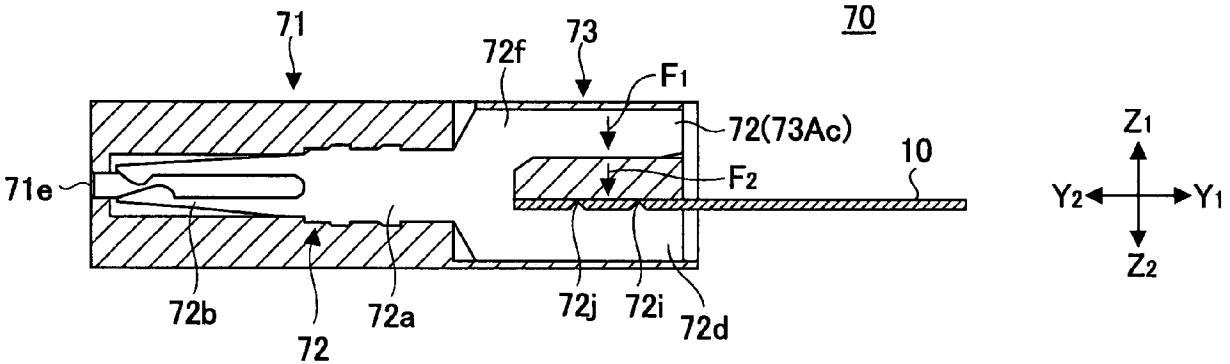
FIG. 14 is a cross-sectional view of a jack connector.
Figure 15:
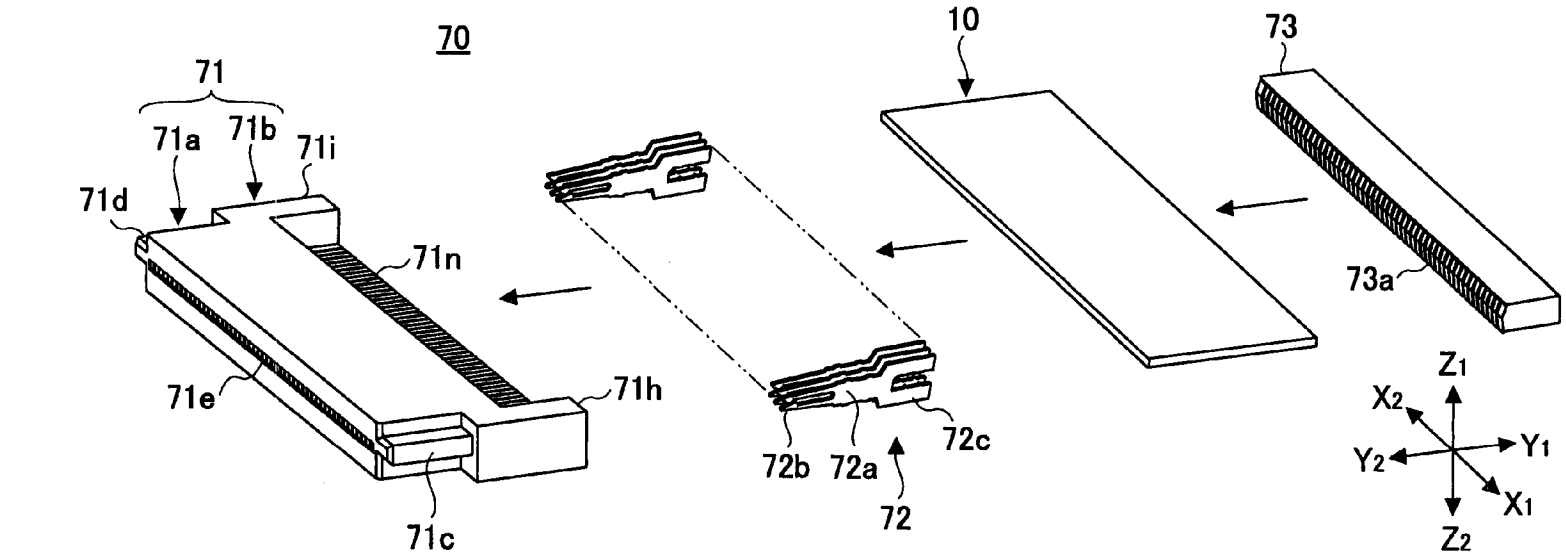
FIG. 15 is an exploded perspective view of the jack connector.
Figure 16:
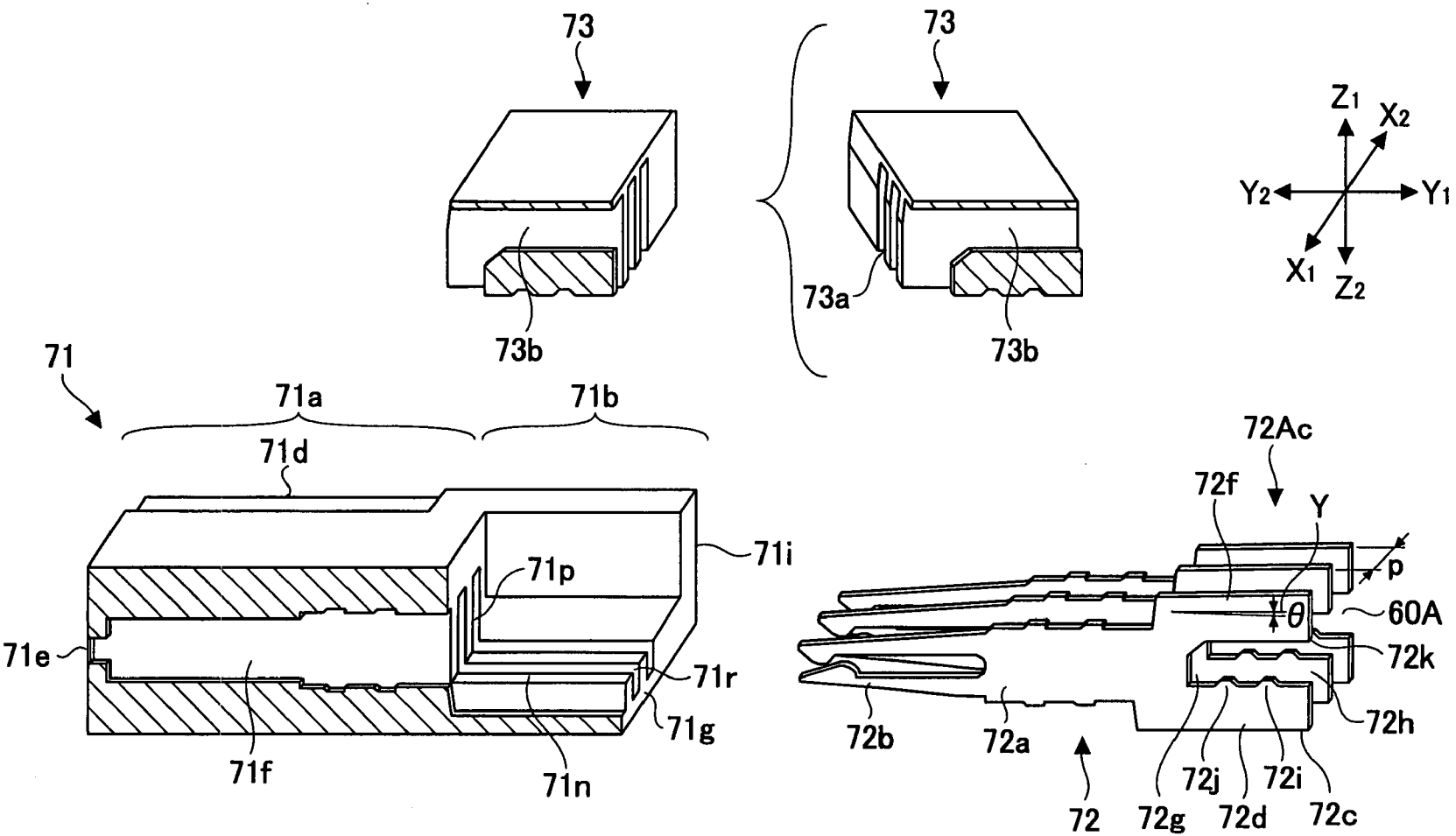
FIG. 16 is an exploded perspective cross-sectional view of the jack connector.

FIG. 14 is a cross-sectional view illustrating the jack connector 70. FIG. 15 is an exploded view illustrating the jack connector 70. FIG. 16 is an exploded cross-sectional view of the jack connector 70.

The jack connector 70 includes an insulating housing 71, multiple plate contact members 72 arranged in the X direction in the housing 71, and an insulating slider 73 configured to fit the housing 71. The unterminated end of the FFC 10 is connected to the jack connector 70 without soldering.

Each of the contact members 72 includes a center section 72*a* having a bulging portion, a pinch contact section 72*b* at the Y2 side, and an FFC connection contact section 72*c* at the Y1 side. The center section 72*a* and the pinch contact section 72*b* are identical to the center section 52*a* and the pinch contact section 52*b* of FIG. 9. The FFC connection contact section 72*c* has a U-shape opened toward the Y1-side, and includes a Z1-side horizontal arm section 72*f*, a Z2-side horizontal arm section 72*d*, a clearance 72*g*, an opening 72*h*, and triangular projections 72*i* and 72*j* formed on the Z2-side horizontal arm section 72*d*. The Z1-side horizontal arm section 72*f* is inclined toward the Z2 side at a small angle θ with respect to a Y-axis and is elastically slightly deformable in the Z1 direction. The Z2-side horizontal arm section 72*d* serves as a first arm, while the Z1-side horizontal arm section 72*f* serves as a second arm.

The housing 71 includes a Y2-side housing section 71*a* at the Y2 side, and a Y1-side housing section 71*b* at the Y1 side. The Y2-side housing the housing section 71*a*, which is identical to the Y2-side housing the housing section 51*a*, includes guide rails 71*c* and 71*d*, slits 71*f*, and slit ports 71*p*. The Y1-side housing section 71*b* has a box shape, which is elongated in the X direction and configured to accommodate the FFC connection contact sections 72*c* therein, with the Z1 and Y1 sides thereof opened, and includes a bottom plate 71*g* at the Z2 side, end face plates 71*h* and 71*i* opposing each other in the X direction, and partition ribs 71*n* formed on the bottom plate 71*g*.

Referring to FIG. 16, the pinch contact sections 72*b* and the center sections 72*a* of the contact members 72 are pushed into the corresponding slits 71*f*. The FFC connection contact sections 72*c* are arranged in the X direction at the intervals p in the Y1-side housing section 71*b*. The Z2-side horizontal arm sections 72*d* of the FFC connection contact sections 72*c* are fitted into the corresponding slits 71*r*, while adjacent FFC connection contact sections 72*c* are separated by the partition ribs 71*n*. The FFC connection contact sections 72*c* arranged in the X direction are referred to as an FFC connection contact section array 72Ac. In the FFC connection contact section array 72Ac, a groove 60A opened toward the Y1 side and elongated in the X direction is formed.

With reference to FIGS. 15 and 16, the slider 73 is a rectangular solid with a size that tightly fits into the Y1-side housing section 71*b* from the Y1 side, and includes slit ports 73*a* each extending across a Y2-side face and a Z2-side face thereof, and slits 73*b* extending inwardly in the Y1 direction from the corresponding slit ports 73*a*.

Figure 17:
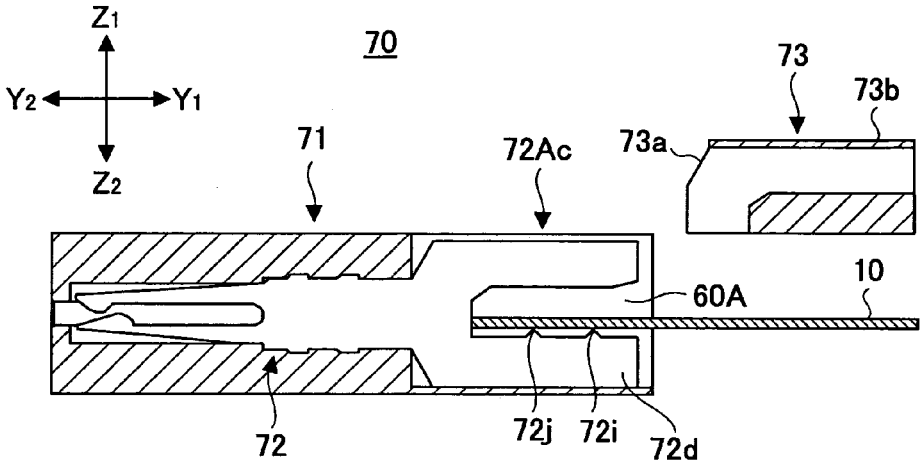
FIG. 17 is a diagram illustrating operations for connecting the FFC to the jack connector.

Referring to FIG. 17, the simply cut and unterminated end of the FFC 10 is inserted into the groove 60A from the Y1 side until the end abuts the groove 60A. The slider 73 is strongly pushed into the Y1-side housing section 71*b* to be fitted into the groove 60A. In this way, the FFC 10 is electrically and mechanically connected to the jack connector 70. More specifically, each of the Z1-side horizontal arm sections 72*f* is relatively inserted into the corresponding slit 73*b* and is elastically deformed in the Z1 direction. The slider 73, to which an elastic force F1 (FIG. 14) of the Z1-side horizontal arm section 72*f* is applied, strongly pushes the FFC 10 against the Z2-side horizontal arm section 72*d* with a force F2, so that the projections 72*i* and 72*j* pierce a polyester covering 12 to come into contact with and press the wire 11 in the same manner as shown in FIG. 12B. As such, the FFC 10 is electrically and mechanically connected to the jack connector 70. The FFC connection contact sections 72*c* are covered with the slider 73.

Referring to FIG. 13, the guide rails 71*c* and 71*d* of the jack connector 70 are guided by the guide grooves 41*f* and 41*g*, and the pin contact sections 42*a* relatively pass through the openings 71*e* to be inserted into the corresponding pinch contact sections 72*b*. Thus, the jack connector 70 is connected to the plug connector 40. As a result, the wires 11 at the end of the FFC 10 are electrically connected to the printed board 20 through the connector device 30A.

[Third Embodiment]

Figure 18:
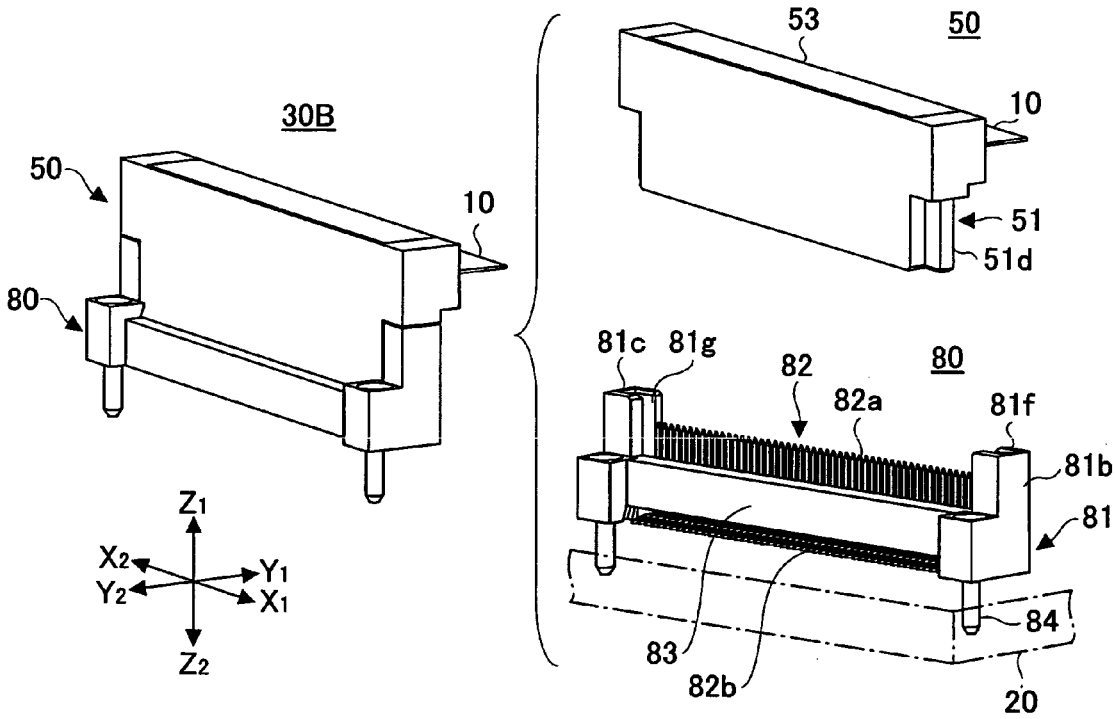
FIG. 18 is a perspective view illustrating a connector device according to a third embodiment of the present invention.

FIG. 18 shows a connector device 30B according to a third embodiment of the present invention. The connector device 30B includes a straight plug connector 80 mounted on a printed board 20, and a jack connector 50 to which an unterminated end of an FFC 10 is electrically and mechanically connected. The jack connector 50 is configured to be connected to the plug connector 80.

Figure 19:
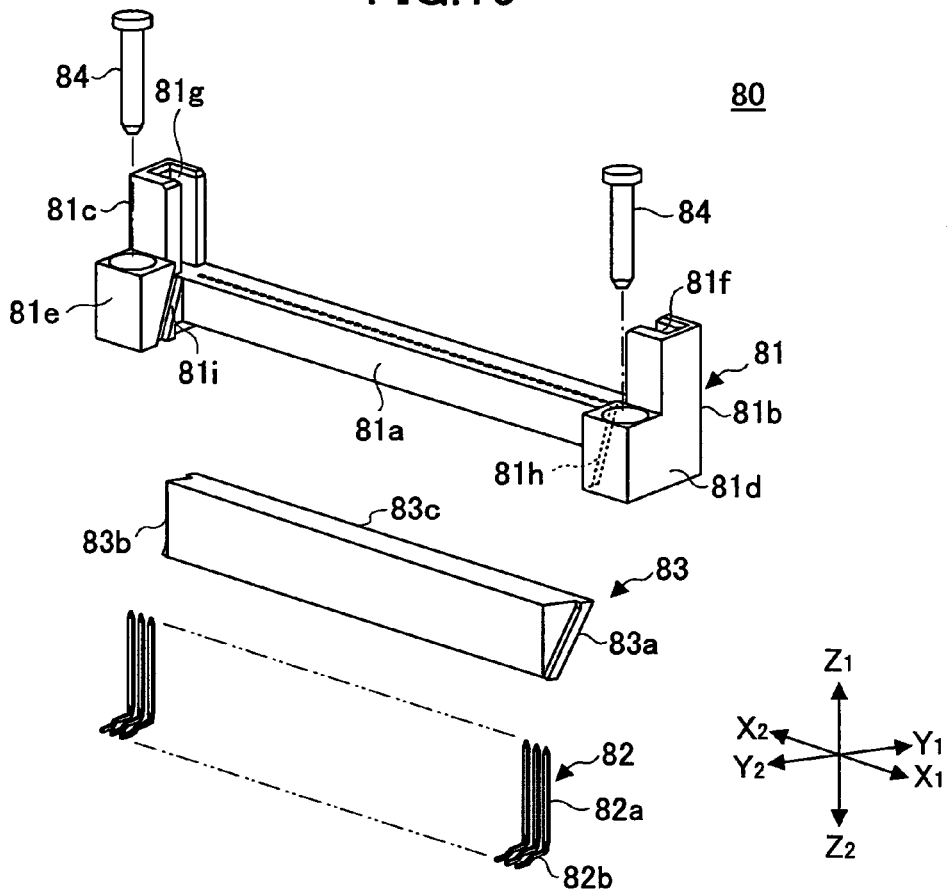
FIG. 19 is a perspective view illustrating a plug connector.

Referring to FIGS. 18 and 19, the plug connector 80 serving as a board-side connector includes a housing 81, multiple pin type contact members 82 inserted in the Z direction through the housing 81 and arranged in the X direction, a dust-proof cover 83 attached to the Y2 side of the housing 81, and a pair of positioning pins 84 threaded through the housing 81 in the Z direction and fixed thereto for mounting the plug connector 80 on the printed board 20.

The housing 81 includes a main section 81*a* elongated in the X direction, arms 81*b* and 81*c* extending in the Z1 direction from opposing ends of the main section 81*a*, respectively, and horizontal arms 81*d* and 81*e* extending in the Y2 direction. Guide grooves 81*f* and 81*g* are formed on opposing inner faces of the arms 81*b* and 81*c*, respectively. Diagonal guide grooves 81*h* and 81*i* for guiding the dust-proof cover 83 are formed on opposing inner faces of the horizontal arm sections 81*d* and 81*e*, respectively.

Each of the contact members 82 includes a pin contact section 82*a* and a Z2-side terminal section 82*b* folded to the Y2 side. The contact members 82 are inserted through holes of the main section 81*a* such that the pin contact sections 82*a* are arranged between the arms 81*b* and 81*c* in the X direction to extend toward the Z1 direction, and that the terminal sections 82*b* are arranged in the X direction between the horizontal arms 81*d* and 81*e* to extend toward the Y2 direction.

Figure 20A:
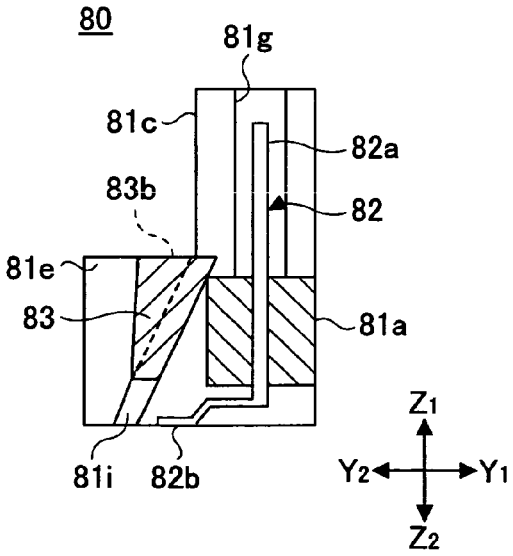
FIGS. 20A and 20B are cross-sectional views each illustrating the plug connector.

The dust-proof cover 83 formed in an elongated plate shape includes guide rails 83*a* and 83*b*. The guide rails 83*a* and 83*b* are configured to slidingly fit into the guide grooves 81*h* and 81*i*, respectively, such that the dust-proof cover 82 is attached between the horizontal arms 81*d* and 81*e*. During assembly of the plug connector 80, the dust-proof cover 83 is located in an upper position, I.e., an opening position shown in FIG. 20A to keep the terminal sections 82*b* uncovered.

The plug connector 80 is mounted on the printed board 20 by reflow soldering the terminal sections 82*b* to a pad formed on the printed board 20, while keeping the dust-proof cover 83 opened. Because the dust-proof cover 83 is opened to expose the terminal sections 82*b*, reflow soldering can be smoothly performed. A flat upper face 83*c* of the dust-proof cover 83 serves as a sucking face when a mounting device vacuum sucks the plug connector 80.

Figure 20B:
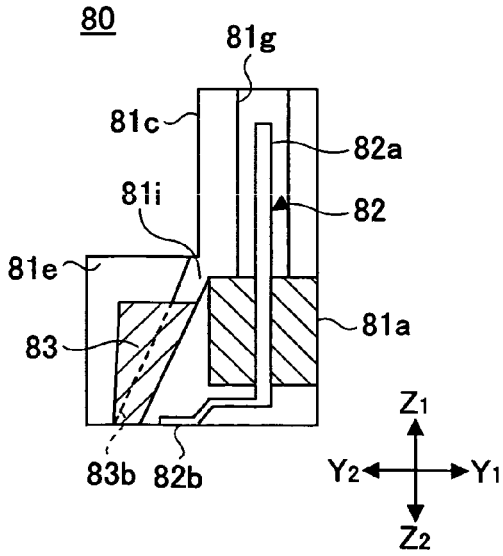

With reference to FIG. 18, guide rails 51*d* of the jack connector 50 are guided by the guide grooves 81*f* and 81*g* of the plug connector 80, so that the jack connector 50 is connected to the plug connector 80. The dust-proof cover 83 is pushed and moved diagonally downwardly along the guide grooves 81*h* and 81*i* by a front end face of the jack connector 50 to cover the terminal sections 82*b* as shown in FIG. 20B. When the jack connector 50 is connected to the plug connector 80, wires 11 at the end of the FFC 10 are electrically connected to the printed board 20 through the connector device 30B.

[Fourth Embodiment]

Figure 21:
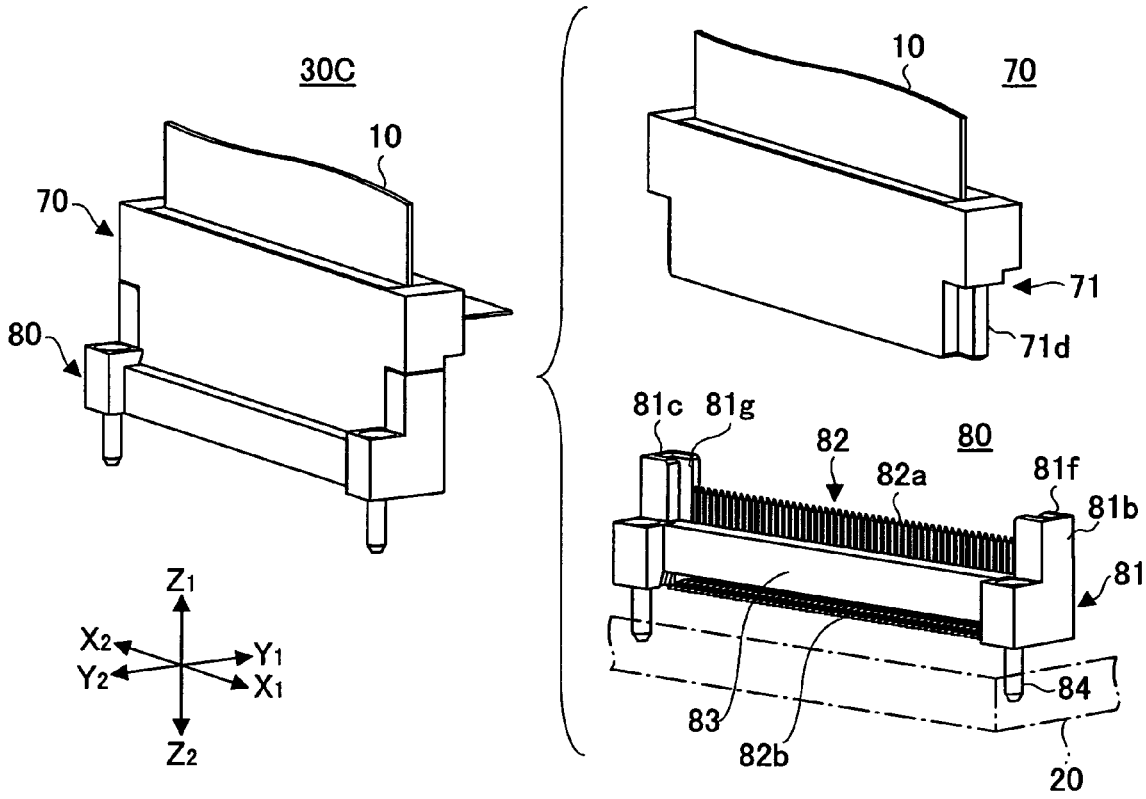
FIG. 21 is a perspective view illustrating a connector device according to a fourth embodiment of the present invention.

FIG. 21 shows a connector device 30C according to a fourth embodiment of the present invention. The connector device 30C includes a straight plug connector 80 mounted on a printed board 20, and a straight jack connector 70 to which an unterminated end of an FFC 10 is electrically and mechanically connected. Guide rails 71*d* of the jack connector 70 are guided by guide grooves 81*f* and 81*g* of the plug connector 80, so that the jack connector 70 is connected to the plug connector 80. When the jack connector 70 is connected to the plug connector 80, wires 11 at the end of the FFC 10 are electrically connected to the printed board 20 through the connector device 30C.

The present application is based on Japanese Priority Application No. 2004-380580 filed on Dec. 28, 2004, with the Japanese Patent Office, the entire contents of which are hereby incorporated by reference.

What is claimed is:

1. A connector to which an end of a flat ribbon cable including a conductive line covered with a covering is to be connected, comprising:

a housing;

a contact member secured to the housing, including a flat flexible cable connection contact section comprising a first arm and a second arm opposing each other forming a U-shape receiving the end of the flat flexible cable therein, the first arm including a projection on an edge thereof opposing an edge of the second arm, the respective edges of the first and second arms defining opposing inner edges of the U-shaped flat flexible cable connection contact section; and a slider configured to elastically deform the flat ribbon connection contact section;

wherein the second arm is inclined in a direction to narrow an open side of the flat ribbon connection contact section and is configured to be elastically deformed when the slider is fitted with respect to the flat flexible connection contact section and an elastic force is generated in the flat flexible connection contact section, and the slider presses the flat flexible cable against said at least one of the opposing inner edges of the flat flexible connection contact section such that the projection of the first arm pierces the covering of the flat flexible cable to come into contact with and press against the conductive line.

2. The connector as claimed in claim 1, wherein:

the housing includes a housing section configured to accommodate the flat ribbon cable connection contact section; and the housing section includes a positioning section adapted to determine a position of the inserted flat ribbon cable in a width direction of the flat ribbon cable.

3. The connector as claimed in claim 1, wherein the flat ribbon cable connection contact section of the contact member includes a plurality of projections, each of said projections having a size corresponding to a thickness of the covering of the flat ribbon cable.

4. The connector as claimed in claim 1, wherein the slider is configured to cover the second arm of the flat ribbon connection contact section when the slider is fitted with respect to the flat ribbon cable connection contact section.

5. The connector as claimed in claim 1, wherein:

the flat ribbon cable connection contact section of the contact member includes a first arm and a second arm opposing each other to form the. U-shape;

the second arm is configured to be elastically deformed when the slider is fitted with respect to the flat ribbon connection contact section;

the first arm includes the projection on an edge opposing the second arm;

the housing includes a housing section accommodating the flat ribbon cable connection contact section, and a partition rib disposed inside the housing section for defining a position of the first arm;

the slider includes a slit into which the second arm is inserted relatively when the slider is fitted with respect to the flat ribbon connection contact section; and the position of the first arm and the second arm are fixed while the first arm is covered with the housing section and the second arm is accommodated inside the slider.

6. A board-side connector mounted on a board and to which the connector of claim 1 is connected, comprising:

a terminal section connected to the board; and a dust-proof cover configured to be pushed by the connector when the connector is connected to the board-side connector so as to cover the terminal section connected to the board.

* * * * *

UNITED STATES PATENT AND TRADEMARK OFFICE

CERTIFICATE OF CORRECTION

PATENT NO. : 7,165,991 B2
APPLICATION NO. : 11/184867
DATED : January 23, 2007
INVENTOR(S) : Koki Sato et al.

It is certified that error appears in the above-identified patent and that said Letters Patent is hereby corrected as shown below:

Column 12, Line 4, after "the" delete ".".

Signed and Sealed this

Twenty-second Day of May, 2007

JON W. DUDAS
*Director of the United States Patent and Trademark Office*